US007303151B2

(12) United States Patent
Wu

(10) Patent No.: US 7,303,151 B2
(45) Date of Patent: Dec. 4, 2007

(54) SHOWER HEAD ASSEMBLY

(76) Inventor: James Wu, NO. 1, Alley16, Lane40, Jinde Rd., East District, Taichung City401 (TW)

( * ) Notice: Subject to any disclaimer, the term of this patent is extended or adjusted under 35 U.S.C. 154(b) by 409 days.

(21) Appl. No.: 11/146,474

(22) Filed: Jun. 7, 2005

(65) Prior Publication Data

US 2006/0273201 A1 Dec. 7, 2006

(51) Int. Cl.
*A62C 31/00* (2006.01)

(52) U.S. Cl. ..... 239/447; 239/436; 239/443; 239/562; 239/382; 239/600; 239/390

(58) Field of Classification Search ..... 239/390, 239/525, 443, 569, 380, 302, 447, 436, 382, 239/562, 600, 391–399, 381, 442, 448, 548
See application file for complete search history.

(56) References Cited

U.S. PATENT DOCUMENTS 5,090,624 A * 2/1992 Rogers ..... 239/381
5,433,384 A * 7/1995 Chan et al. ..... 239/449
5,765,760 A * 6/1998 Kuo ..... 239/440
6,076,743 A * 6/2000 Fan ..... 239/99
6,230,989 B1 * 5/2001 Haverstraw et al. ..... 239/443
6,412,710 B1 * 7/2002 Lin et al. ..... 239/436
6,565,018 B1 * 5/2003 Degeyter ..... 239/581.1
6,622,945 B1 * 9/2003 Wu et al. ..... 239/443

* cited by examiner

*Primary Examiner*—Joe H. Cheng
*Assistant Examiner*—Steven M Cernoch
(74) *Attorney, Agent, or Firm*—Pro-Techtor Int'l Services

(57) ABSTRACT

A shower head assembly includes a hollow handle and a head. A base plate is engaged with the head and a rotatable member is connected to the head and a fixed plate is secured to the rotatable member. Two tubular members are located between the fixed plate and the base plate. Two springs are received in two respective interiors of the two tubular members and biased between the fixed plate and the base plate. A pattern plate having a plurality of pattern holes is fixed to the rotatable member. A filtering assembly including a cap, an adjusting member with a plurality of ribs, a first filter, a separation ring with a plurality of holes and a second filter. A bolt extends through the filtering assembly and connecting the filtering assembly to the pattern plate. A volume control device is engaged with a connection hole defined through a wall of the handle so as to control water volume through the handle.

6 Claims, 5 Drawing Sheets

SHOWER HEAD ASSEMBLY

FIELD OF THE INVENTION

The present invention relates to a shower head that includes a volume control device for controlling volume of water flowing through the shower head.

BACKGROUND OF THE INVENTION

A conventional shower head 80 is shown in FIGS. 1 and 2 and generally includes a handle 81 and a head 811 is connected to an end of the handle 81. The head 811 includes a tubular chamber 812 therein and a connection tube 813 extends from an inside of the head 811. A fixed plate 82 is fixed in the chamber 812 by a screw 822 extending through a washer 823 and a central hole 824 of the fixed plate 82 and threaded connected to the connection tube 813. The fixed plate 82 includes a plurality of outlets 821. A rotatable member 83 is mounted to the fixed plate 82 and a ring 84 is located between the rotatable member 83 and the fixed plate 82. A pattern member 85 is connected to the rotatable member 83 and includes a plurality of pattern holes 851 so that when rotating the rotatable member 83, water goes through different pattern holes 851 of the pattern member 85.

Although the pattern of water that flows out from the pattern holes 851 can be adjusted, the volume of water going through the shower head cannot be adjusted and this might lead to an extra and unnecessary use of water.

The present invention intends to provide a shower head that is cable adjust the volume of water flowing through the shower head.

SUMMARY OF THE INVENTION

The present invention relates to a shower head assembly that comprises a hollow handle and a head on an end of the handle. A chamber is defined in the head and a connection tube extends from a center of the chamber. A base plate is engaged with the chamber and a through hole is defined through a center of the base plate. A rotatable member has a neck portion extending from a first end thereof and two notches are defined in an inner periphery of the rotatable member. A fixed plate has two protrusions which are engaged with the notches of the rotatable member. Two tubular members are located between the fixed plate and the base plate and two springs are received in two respective interiors of the two tubular members. A positioning member has a threaded through hole defined therethrough and a screw threadedly extends through the threaded through hole and is connected to the connection tube. A pattern plate has a plurality of pattern holes and fixed to a second end of the rotatable member. A filtering assembly including a cap, an adjusting member with a plurality of ribs, a first filter, a separation ring with a plurality of holes and a second filter. A bolt extends through the filtering assembly and connects the filtering assembly to the pattern plate.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
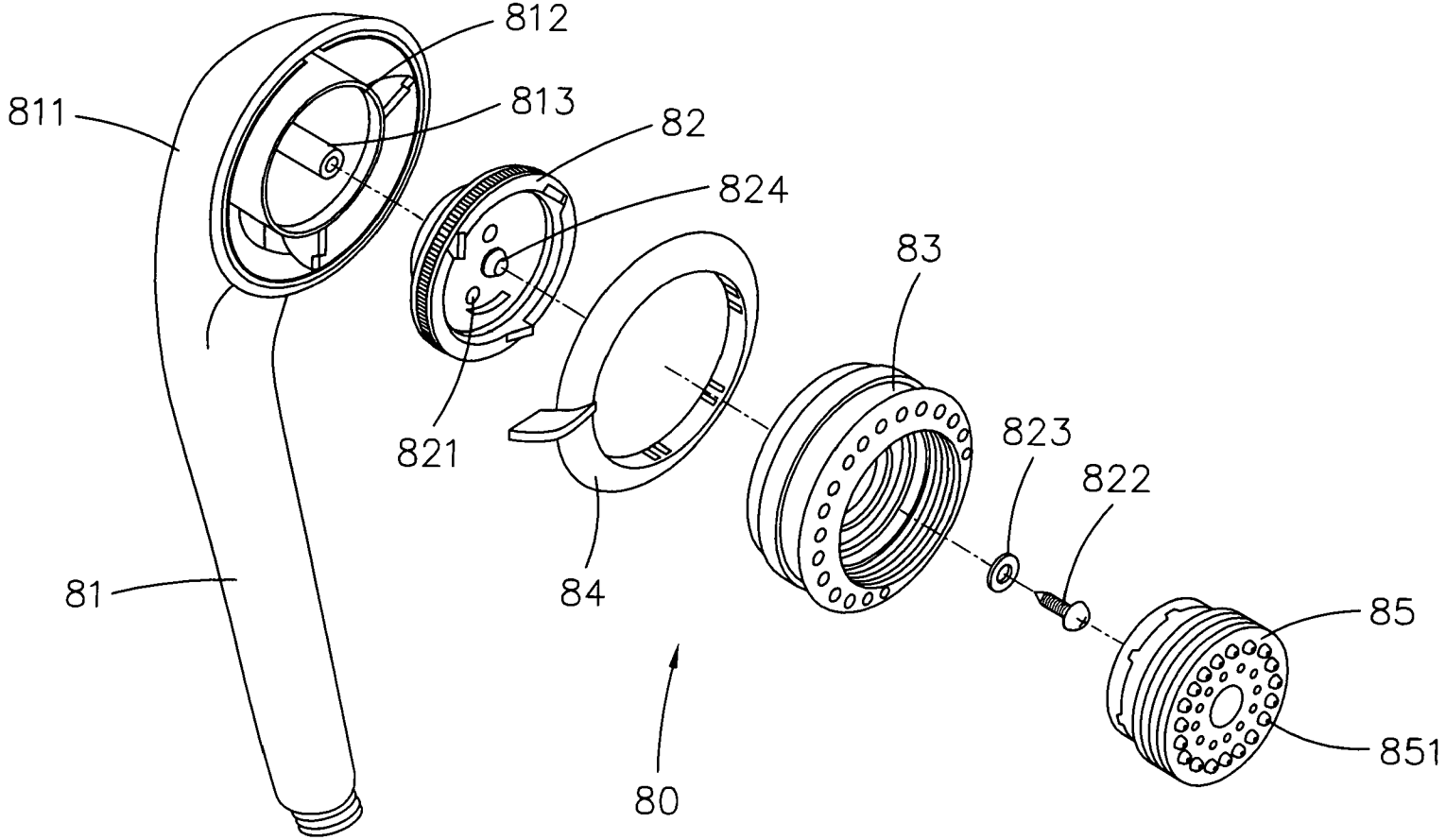
FIG. 1 PRIOR ART
FIG. 1 is an exploded view to show a conventional shower head.
Figure 2:
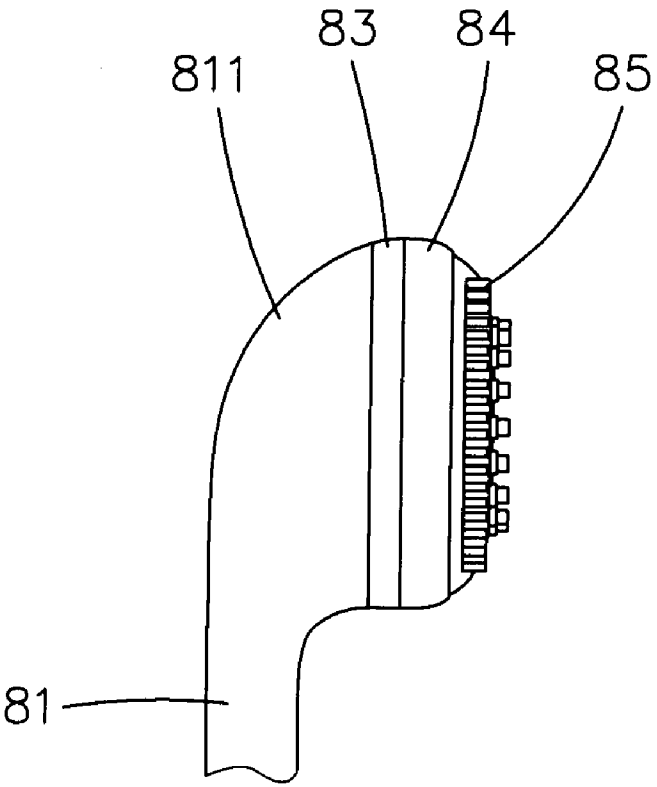
FIG. 2 PRIOR ART
FIG. 2 is a side view to show the conventional shower head.
Figure 3:
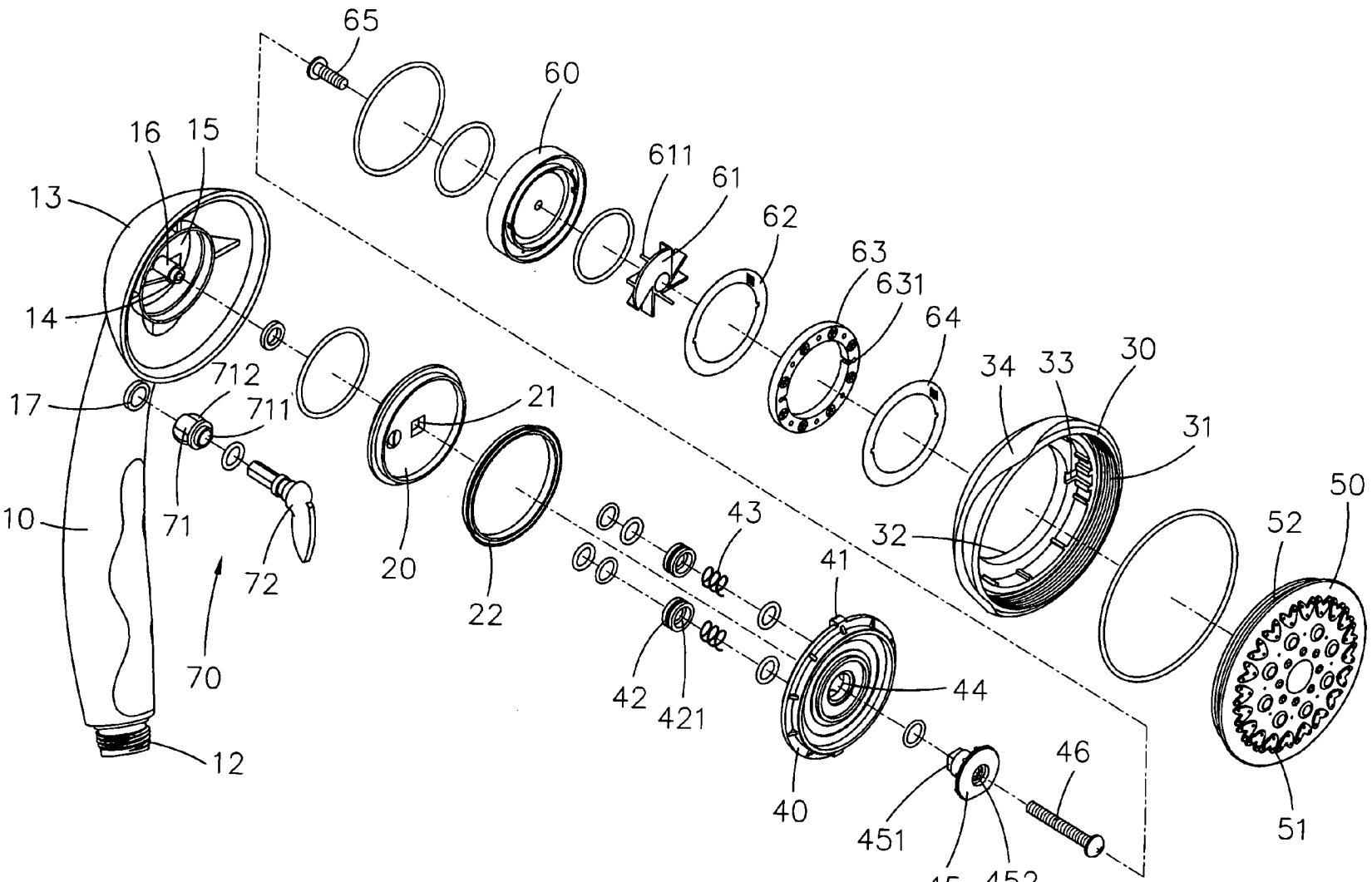
FIG. 3 is an exploded view to show the shower head assembly of the present invention.
Figure 4:
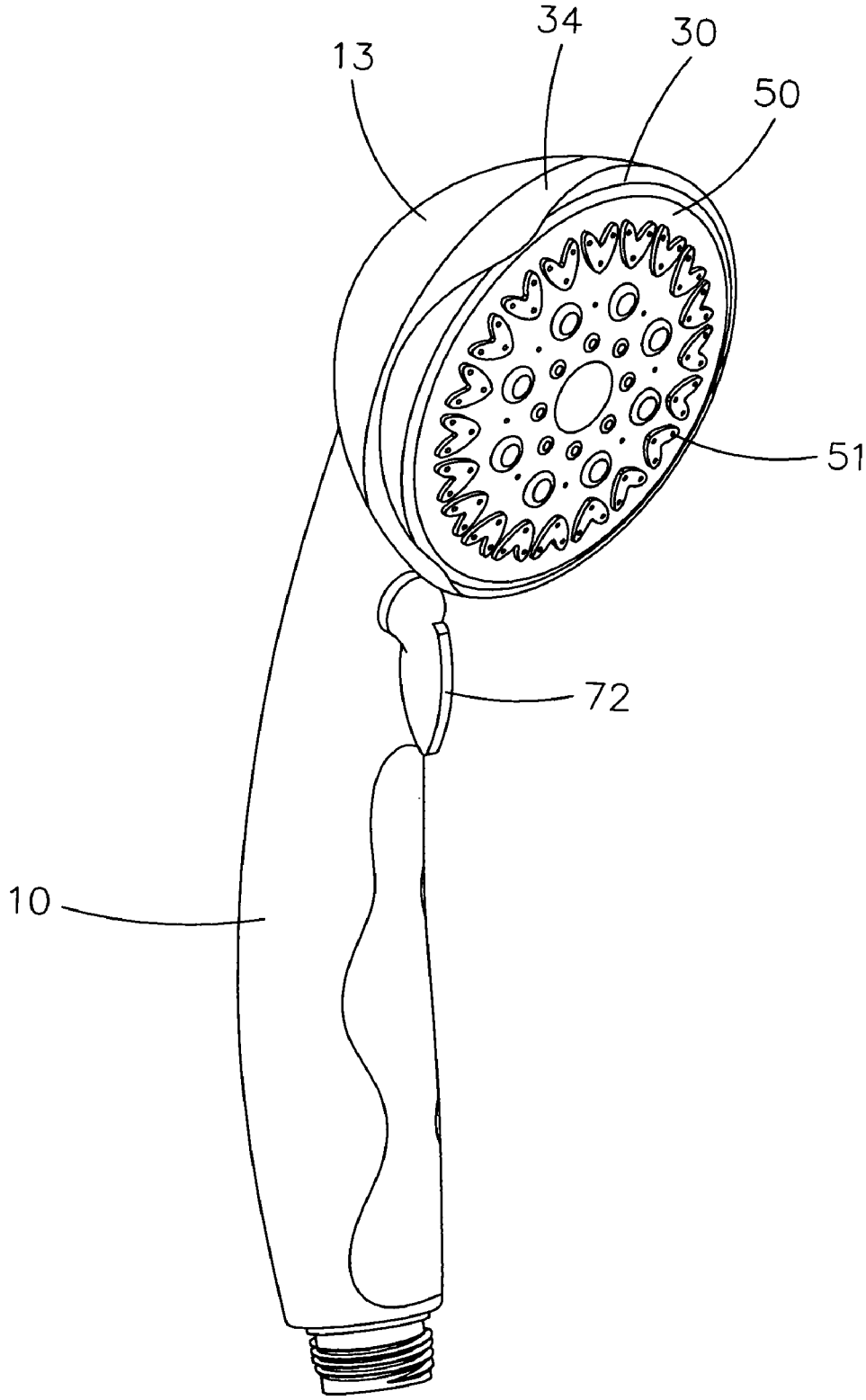
FIG. 4 is a perspective view to show the shower head assembly of the present invention.
Figure 5:
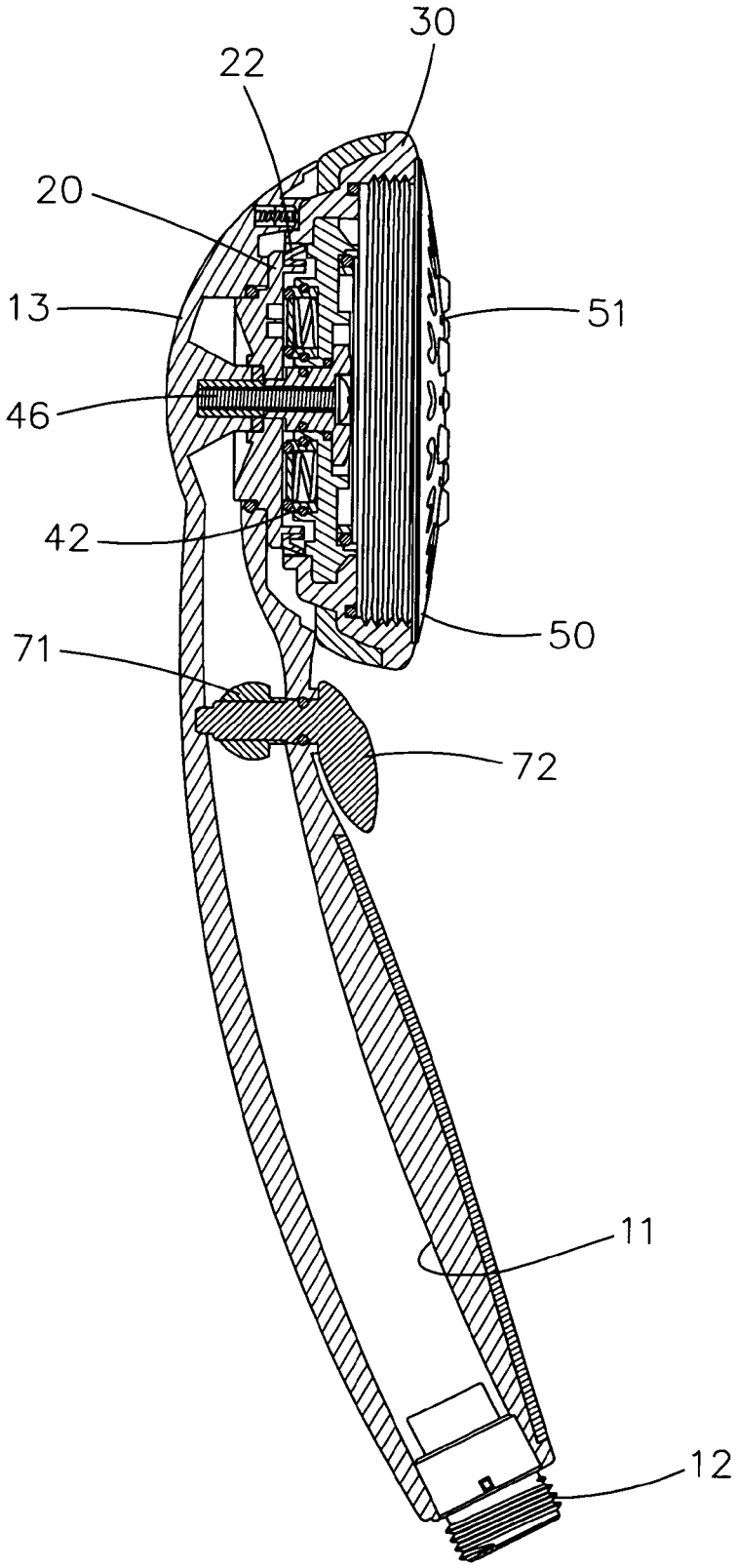
FIG. 5 is a cross sectional view to show the shower head assembly of the present invention.

Referring to FIGS. 3 to 5, the shower head of the present invention comprises a hollow handle 10 and a head 13 connected to an end of the handle 10. A connection end 12 is connected to the other end of the handle 10 so as to be connected to a hose (not shown) through which water enters the hollow handle 10 and flows out from the head 13. A chamber 15 enclosed by a cup or tubular wall 14 is defined in the head 13 and a connection tube 16 extends from a center of the chamber 15. A base plate 20 with a seal 22 mounted to an outside thereof is engaged with the chamber 15 and a rectangular through hole 21 is defined through a center of the base plate 20.

A rotatable member 30 has a neck portion 32 extending from a first end thereof and two notches 33 are defined in an inner periphery of the rotatable member 30. A fixed plate 40 has two protrusions 41 which are engaged with the notches 33 of the rotatable member 30. Two tubular members 42 are located between the fixed plate 41 and the base plate 21, and two springs 43 are received in two respective interiors 421 of the two tubular members 42. The springs 43 are biased between the fixed plate 40 and the base plate 20.

A positioning member 45 has a threaded through hole 452 defined therethrough and a rectangular insertion 451 which extends through a hole 44 in the fixed plate 40 and engaged with the through hole 21 in the base plate 20. A screw 46 threadedly extends through the threaded through hole 452 and is connected to the connection tube 16.

A pattern plate 50 has a plurality of pattern holes 51 and a threaded outer periphery 52 which is connected to a threaded inner periphery 31 of the rotatable member 30. A filtering assembly is located between the pattern plate 50 and the fixed plate 40. The filtering assembly includes a cap 60, an adjusting member 61 with a plurality of ribs 611, a first filter 62, a separation ring 63 with a plurality of holes 631 and a second filter 64. A bolt 65 extends through the filtering assembly and connects the filtering assembly to the pattern plate 50.

A volume control device 70 is engaged with a connection hole 17 defined through a wall of the handle 10. The volume control device includes a sleeve 71 and a control rod 72 which extends through a passage 711 defined axially through the sleeve 71 so that the sleeve 71 is rotated by rotating the control rod 72. The sleeve 71 is located in the hollow handle 10 and includes a plurality of wings 712 extending from an outer periphery thereof such that when rotating the sleeve 71, the water volume passing through the handle 10 is adjusted.

The users may hold the rough outer surface 34 on the rotatable member 30 to rotate the rotatable member 30 together with the pattern plate 85 to change the way that the water comes out from the pattern holes 851. The user my also operate the control rod 72 to adjust the volume of water passing through the handle 10 by the area of the wings 712 across the hollow handle 10.

While we have shown and described the embodiment in accordance with the present invention, it should be clear to those skilled in the art that further embodiments may be made without departing from the scope of the present invention.

What is claimed is:

1. A shower head assembly comprising:

a hollow handle and a head connected to an end of the handle, a chamber defined in the head and a connection tube extending from a center of the chamber;

a base plate engaged with the chamber and a through hole defined through a center of the base plate;

a rotatable member having a neck portion extending from a first end thereof and two notches defined in an inner periphery of the rotatable member;

a fixed plate having two protrusions which are engaged with the notches of the rotatable member, two tubular members located between the fixed plate and the base plate, two springs received in two respective interiors of the two tubular members;

a positioning member having a threaded through hole defined therethrough and a screw threadedly extending through the threaded through hole and being connected to the connection tube;

a pattern plate having a plurality of pattern holes and fixed to a second end of the rotatable member, and a filtering assembly including a cap, an adjusting member with a plurality of ribs, a first filter, a separation ring with a plurality of holes and a second filter, a bolt extending through the filtering assembly and connecting the filtering assembly to the pattern plate.

2. The assembly as claimed in claim 1, wherein a volume control device is engaged with a connection hole defined through a wall of the handle, the volume control device includes a sleeve and a control rod which extends through a passage defined axially through the sleeve so that the sleeve is rotated by rotating the control rod, the sleeve is located in the hollow handle and includes a plurality of wings extending from an outer periphery thereof.

3. The assembly as claimed in claim 1, wherein the through hole of the rotatable member is a rectangular hole and the positioning member includes a rectangular insertion which is engaged with the rectangular through hole of the rotatable member.

4. The assembly as claimed in claim 1, wherein a seal is mounted to an outside of the base plate.

5. The assembly as claimed in claim 1, wherein the rotatable member includes a threaded inner periphery and the pattern plate includes a threaded outer periphery which is connected to the threaded inner periphery of the rotatable member.

6. The assembly as claimed in claim 1, wherein the rotatable member includes a rough outer surface.

* * * * *